United States Patent [19]

Holmes et al.

[11] 4,323,991

[45] Apr. 6, 1982

[54] FLUIDIC MUD PULSER

[75] Inventors: Allen B. Holmes, Rockville; Stacy E. Gehman, Takoma Park; Maurice F. Funke, Columbia, all of Md.

[73] Assignee: The United States of America as represented by the Secretary of the Army, Washington, D.C.

[21] Appl. No.: 74,636

[22] Filed: Sep. 12, 1979

[51] Int. Cl.[3] ..... G01V 1/40

[52] U.S. Cl. ..... 367/83; 181/106; 181/119; 367/912; 137/808; 137/813

[58] Field of Search ..... F15C/1/16; 181/106, 181/119, 120; 367/83, 912; 166/113; 175/40, 50; 33/306; 137/808, 810, 812, 813; 235/201 PF

[56] References Cited

U.S. PATENT DOCUMENTS

| | | | |
|---|---|---|---|
| 3,237,712 | 3/1966 | Horton | 181/142 |
| 3,238,960 | 3/1966 | Hatch | 137/812 |
| 3,373,759 | 3/1968 | Adams | 137/810 |
| 3,470,894 | 10/1969 | Rimmer | 137/812 |
| 3,481,426 | 12/1969 | Silverman | 181/120 |
| 3,537,466 | 11/1970 | Chapin | 137/810 |
| 3,674,044 | 7/1972 | Mayer | 137/812 |
| 3,860,902 | 1/1975 | Galle | 367/83 |
| 3,909,776 | 9/1975 | Broding et al. | 181/119 |
| 3,943,855 | 3/1976 | Woodward | 235/201 PF |
| 4,082,169 | 4/1978 | Bowles | 137/810 |
| 4,108,721 | 8/1978 | Drzewiecki et al. | 137/810 |
| 4,134,100 | 1/1979 | Funke | 181/119 |

FOREIGN PATENT DOCUMENTS

| | | | |
|---|---|---|---|
| 1438497 | 6/1976 | United Kingdom | 137/808 |

OTHER PUBLICATIONS

Wormley, "A Review of Vortex Diode . . . Characteristics", 10/03/74, pp. 1-44, NTIS AD787546.

Fineblum, "Vortex Diodes", 10/03/74, pp. 45-80, NTIS AD787546.

Drzewiecki, "The Design of Fluidic . . . Flip Flops", 10/03/74, pp. 433-605, NTIS AD787546.

*Primary Examiner*—Nelson Moskowitz

*Attorney, Agent, or Firm*—Nathan Edelberg; Robert P. Gibson; Saul Elbaum

[57] ABSTRACT

A liquid telemetry system is disclosed useful for transmitting data through a fluid body by means of pulses in the fluid. To generate the pulses in the fluid the system utilizes a bi-stable fluid amplifier in conjunction with a vortex valve. Control input signals direct the flow of fluid from the bi-stable amplifier into the vortex valve in such manner as to selectively impede the flow of fluid through the vortex valve. The resulting changes in fluid flow rates generate pulses within the fluid body.

11 Claims, 7 Drawing Figures

FIG. 4
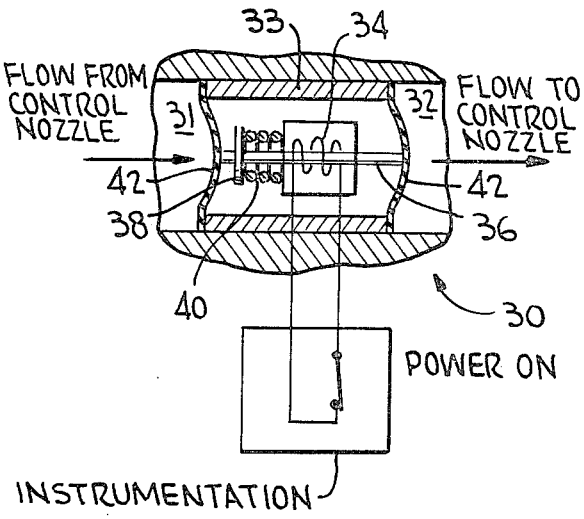
FIG. 5
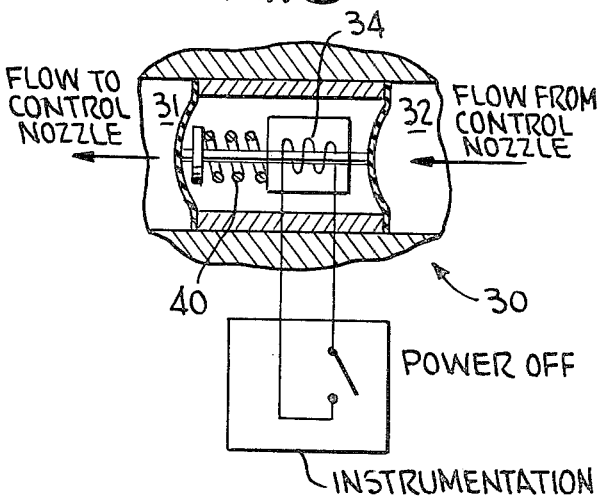
FIG. 6
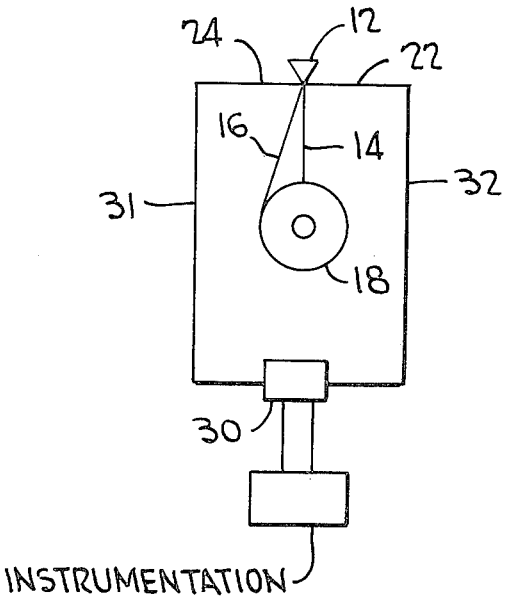
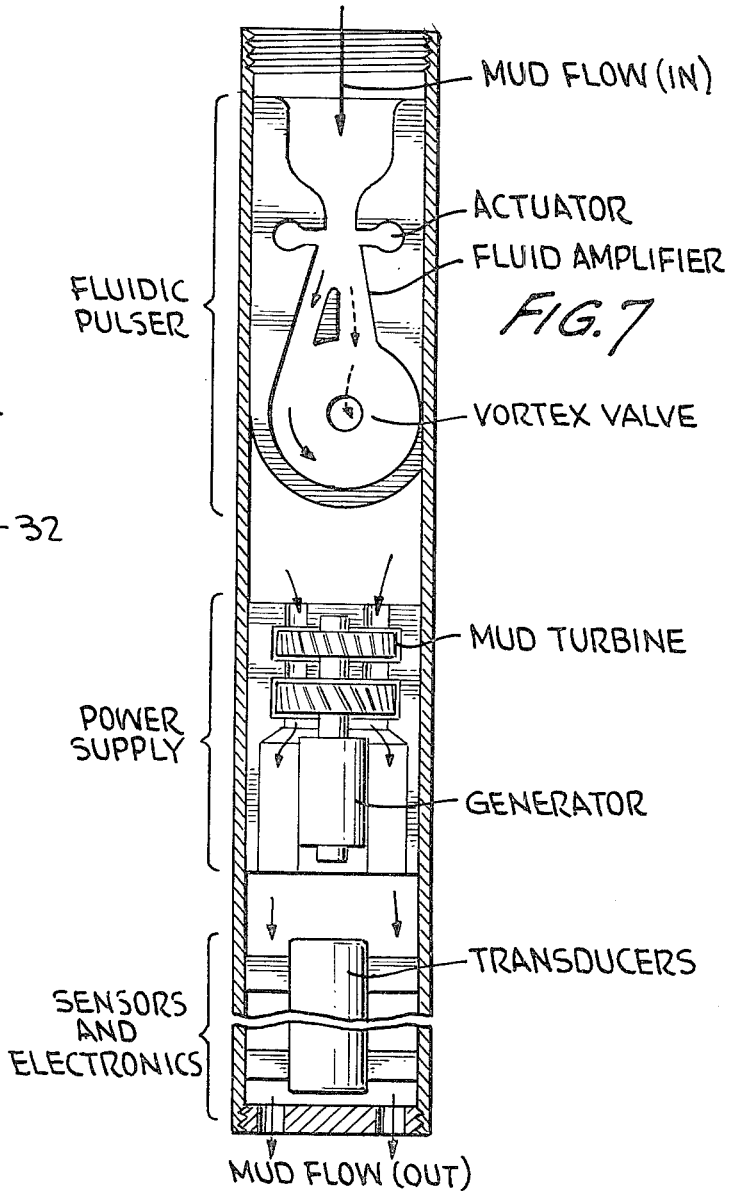
FIG. 7

FLUIDIC MUD PULSER

RIGHTS OF THE GOVERNMENT

The invention described herein may be manufactured, used, and licensed by or for the United States Government for governmental purposes without the payment to me (us) of any royalty thereon.

BACKGROUND OF THE INVENTION

The invention relates to systems for transmitting information from the bottom of a bore hole in the earth to the surface by way of pressure pulses created in a circulating mud stream in a drill string. More particularly, this invention relates to an apparatus for changing the resistance to the flow of the mud stream in the drill string to create pressure pulses therein.

The usefulness of obtaining data from the bottom of an oil, gas or geothermal well during drilling operations without interrupting these operations has been recognized for many years. However, no proven technology reliably provides this capability. Such a capability would have numerous benefits in providing for safer and less costly drilling of both exploration and production wells.

Any system that provides measurements while drilling (MWD) must have three basic capabilities: (1) to measure the down hole parameters of interest; (2) to telemeter the resulting data to a surface receiver; and (3) to receive and interpret the telemetered data.

Of these three essential capabilities, the ability to telemeter data to the surface is currently the limiting factor in the development of an MWD system.

For reasons of economy and safety it is highly desirable that the operator of a drill string be continually aware of such down hole parameters as drill bit position, temperature and bore hole pressure. Knowledge of the drill bit position during drilling would save significant time and expense during directional drilling operations. For safety it is of interest to predict the approach of high pressure zones to allow the execution of proper preventative procedures in order to avoid blowouts. In addition proper operation of the drill string requires continuous monitoring of down hole pressure. The pressure in the bore hole must be maintained high enough to keep the walls of the hole from collapsing on the drill string yet low enough to prevent fracturing of the formation around the bore hole. In addition the pressure at the bit must be sufficient to prevent the influx of gas or fluids when high pressure formations are entered by the drill bit. Failure to maintain the proper down hole pressure can and frequently does lead to loss of well control and blowouts.

Four general methods are being studied that would provide transmission of precise data from one end of the well bore to the other: mud pressure pulse, hard wire, electromagnetic waves, and acoustic methods. At this time, the mud pressure pulse method seems to be the closest to becoming commercially available.

In a typical mud pulsing system pressure pulses are produced by a mechanical valve located in a collar above the drill bit. The pulses represent coded information from down hole instrumentation. The pulses are transmitted through the mud to pressure transducers at the surface, decoded and displayed as data representing pressure, temperature, etc. from the down hole sensors. Of the four general methods named above mud pulse sensing is considered to be the most practical as it is the simplest to implement and requires no modification of existing drill pipe or equipment.

Mechanical mud pulsers known in the art are inherently slow, producing only one to five pulses per second, are subject to frequent mechanical breakdown, and are relatively expensive to manufacture and maintain. An example of such a device is U.S. Pat. No. 3,958,217 which shows a valve mechanism for producing mud pulses.

SUMMARY OF THE INVENTION

Accordingly it is an object of this invention to provide a mud pulse transmitter having a higher data transmission rate.

It is another object of the invention to provide a mud pulse transmitter having no moving parts to jam or wear out and no mechanical seals to cause leaks.

A further object of the invention is to provide a mud pulse transmitter which is inexpensive to fabricate as well as to maintain.

It is still another object of the invention to provide a mud pulse transmitter which can be easily adapted for use with standard well logging instrumentation and can be easily installed in conventional drill collars.

Yet another object of the invention is to provide a mud pulse transmitter which drains very little power from the drill string apparatus.

BRIEF SUMMARY OF THE DRAWINGS

FIGS. 4 and 5 show a suitable embodiment of an actuator element suitable for affecting control input to the pulser.

FIG. 6 is a schematic showing of the relationship between the pulser, the actuator and the instrumentation of the telemetry system.

FIG. 7 is a more detailed showing of a suitable arrangement of the fluidic mud pulser, mud turbine power supply and instrumentation unit as shown in FIG. 1.

DESCRIPTION OF THE PREFERRED EMBODIMENT

Figure 1:
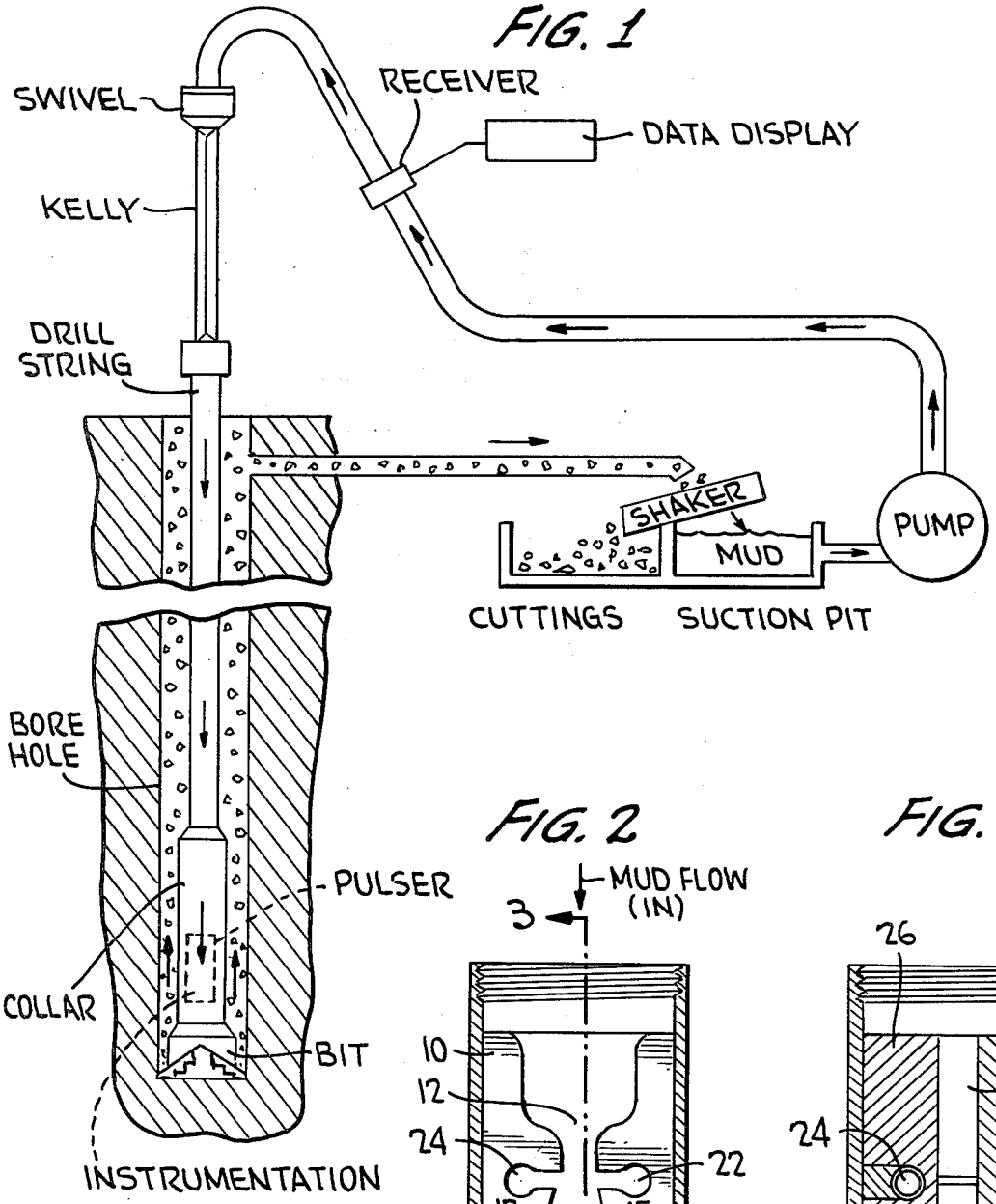
FIG. 1 is a schematic view showing the relationship between the elements of the telemetry system and the drill string.

Referring to FIG. 1 there is shown the general arrangement of a drill string comprising a telemetry system. As the drill string operates to continually increase the depth of the bore hole, a fluid, commonly called mud, is pumped down through the drill string past the drill bit to carry cuttings back up to the surface of the bore hole where they are then separated from the mud. The mud is then recirculated down through the drill string. Mounted generally near the base of the drill string, adjacent the drill bit, is an instrumentation package generally comprising transducers capable of sensing physical parameters in the bore hole.

A pulser is provided in the drill string generally adjacent the instrumentation package for generating pulses in the fluid mud.

A pressure transducer generally denoted as a receiver in FIG. 1 is provided for receiving the pulses in the mud at a location in the drill string generally above ground level. A data display or recording device is associated with the receiver.

In a complete mud pulse telemetry system the pressure signals will be monitored at the surface by the pressure transducer. Electrical power to operate the pulser and down hole electronics will be supplied by a mud turbine driven generator as shown in FIG. 7. Measurements made down hole will be digitized and fed to an actuator. The presence or absence of a signal will represent the binary numbers 0 or 1 as will the presence or absence of a pressure pulse at the surface. The received signals will be converted back into a useable data mode by the pressure transducer. The signals will be decoded and displayed as data.

Figure 2:
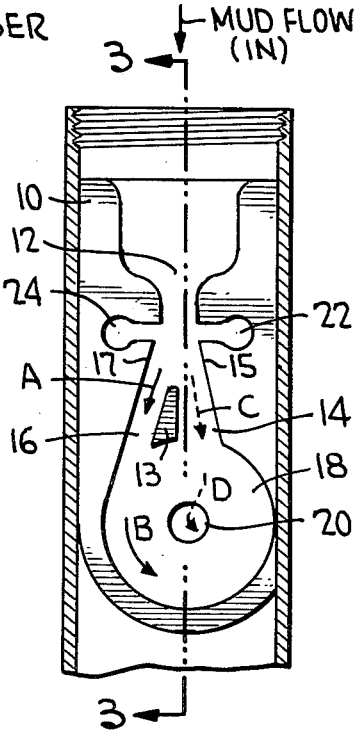
FIG. 2 is a detailed view of the pulser of the apparatus.
Figure 3:
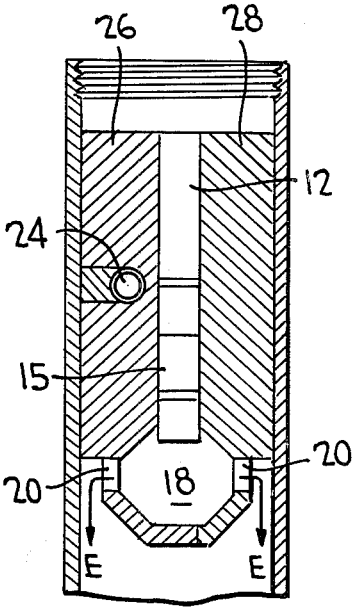
FIG. 3 is a sectional view along line 3—3 of FIG. 2.

FIGS. 2 and 3 show in greater detail the pulser of the invention, designated generally at 10. The pulser comprises a bi-stable fluid amplifier, as is well known in the art, having intake 12, alternate flow paths 14 and 16, and control nozzles 22 and 24. The amplifier operates in a bi-stable mode, meaning that the flow will remain established through a single output 14 or 16 in the absence of a control signal and regardless of the back pressure. The effect causing bi-stable operation results from a complex viscous interaction between the jet flow, the fluid in the inner action chamber of the amplifier and the walls of the chamber, 15 and 17. Output ports 14 and 16 are separated by a divider 13. Outputs 14 and 16, as can be seen in FIG. 2, communicate with vortex valve 18 having outlet sink 20.

The pulser can be formed by any suitable method such as milling or otherwise forming the various elements in a block of material 26 and mating the block of material with a cover portion 28 as shown in FIG. 3. The material from which the pulser is made may comprise metals or plastics or any suitable material depending on the environment in which the pulser is used.

In operation mud entering intake 12 will assume a stable flow condition through output port 16 by attaching to wall 17. Flow through output port 16 will generate a vortical flow in the valve 18 as shown by solid arrows AB in FIG. 2. In the absence of a control signal the fluid flow will remain in this pattern and the vortical motion in the valve will restrict output through outlet sink 20. Upon provision of a positive pressure pulse through control nozzle 24 additional fluid from the control entering the flow in the region of wall 17 will increase pressure in the region of the wall 17 and cause the flow to be diverted in the direction of outlet port 14. A stable flow condition will then be assumed by the fluid through outlet port 14. Flow from outlet port 14 enters the vortex valve radially as shown by dotted arrows CD in FIG. 2. As no vortex is generated in the valve by the radial flow D, the resistance to fluid flow through the output sink 20 is diminished. A greater flow rate through the pulser can thus be achieved. A subsequent positive pressure control pulse from control nozzle 22 will increase the pressure in the fluid flow in the region near the wall 15 and divert the flow again back toward output port 16. It can be seen that by selecting flow path 14 or 16 one may selectively increase or diminish the resistance to flow through the pulser.

The change in flow that occurs in the pulser as a result of the diversion action of the vortex produces a change in the kinetic energy of the mud entering the pulser. This energy is expended in compressing the mud. A wave of increased pressure (water hammer) is produced which propagates back through the pulser supply nozzle 12 and up through the drill string. The amplitude of the wave is primarily a function of mud density and the change in velocity caused by the reduction in flow. The duration of the wave is dependent on actuator response.

It is to be understood that flow through the pulser might initially assume a stable flow condition through output 14. In that event, control signals would be provided to divert the flow to output 16 and back again to output 14 to generate pulses as described above.

FIGS. 4 and 5 illustrate a suitable embodiment of a control element or actuator suitable for providing for the control signals to control nozzles 22 and 24. The actuator 30 is situated at a junction of control channels 31 and 32 which communicate with control nozzles 24 and 22, respectively. The actuator comprises a solenoid mechanism 34, 36; a retaining means 38 mounted on the armature 36 and spring means 40. Diaphragms 42 are controlled by motion of the armature 36. The actuator is held in place in channels 31 and 32 by means of suitable retaining means as shown at 33. As shown in FIG. 4 when the instrumentation in the drill string provides a power signal to coil 34, armature 36 will move to the right compressing spring 40 and creating a positive pressure pulse in channel 32 and a negative pulse in channel 31. The positive pressure in channel 32 will create a pressure signal at control nozzle 22. When the signal from the instrumentation is turned off as shown in FIG. 5, spring 40 will return armature 36 to the left creating a positive pulse in channel 31 and a negative pulse in channel 32 resulting in a positive control signal at control nozzle 24. The instrumentation is capable of providing suitable coded signals to the actuator which are indicative of various physical conditions in the bore hole. These signals can then be transmitted by the pulse mechanism to the receiver assembly above ground level.

FIG. 6 schematically illustrates the relationship between the bistable amplifier having input 12 flow paths 14 and 16, the vortex valve 18, the actuator 30, control channels 31 and 32 and the instrumentation which controls the actuator.

The pulsing system disclosed is an improved highly efficient system in that it is capable of transmitting pulses at a very rapid rate, and therefor is capable of transmitting greater quantities of data in a given time period than previously known mechanical pulsing systems. Further the device has no moving parts to jam or wear out nor mechanical seals to cause leaks. The device is very inexpensive to fabricate and maintain and can be easily adapted for use with standard well logging instrumentation as it can be easily installed in conventional drill collars.

Laboratory tests were conducted to study the flow diversion characteristics of the amplifier and turndown characteristics of the vortex valve. Turndown ratio represents the effective flow reduction caused by the vortex valve. Tests were conducted with Newtonian (water) and non-Newtonian drilling fluids at near ambient back pressure. A solenoid actuator provided the input control signals. A comparison of data indicated no significant change in amplifier switching performance and about a 30% reduction in vortex valve turndown ratio. Nominal turndown ratios measured using drilling fluid ranged between 2 and 2.5/1.

Laboratory test data on turndown ratios and effective nozzle areas were fed to a computer and used to predict operating characteristics as a function of nozzle areas in a standard 4.5 OD by 3.75 ID drill string. Signal pressure levels were computed as a function of turndown ratio for circulation rates of 344 gpm and 172 gpm, mud weights between 8.3 and 20 ppg for assumed bit nozzle area and bypass area. Bypass area may be provided in the drill string so that the entire mud flow need not pass through the pulsing mechanism. Results are tabulated in Table 1.

| THEORETICAL PRESSURE RISE DUE TO TURNDOWN | | | | | |
|---|---|---|---|---|---|
| Mud Wt | Turndown Ratio | | | P | Bit Pres |
| ppg | 2 | 3 | 4 | Psi | Psi |
| | CIRCULATION RATE 344 gmp | | | | |
| 8.33 | 51.4 | 110 | 164 | 82 | 738 |
| 10 | 62 | 133 | 197 | 98 | 886 |
| 15 | 92 | 199 | 296 | 148 | 1329 |
| 20 | 123 | 266 | 395 | 197 | 1772 |
| | CIRCULATION RATE = 172 gpm | | | | |
| 8.33 | 21 | 46 | 71 | 21 | 184 |
| 10 | 25 | 56 | 85 | 25 | 221 |
| 15 | 38 | 84 | 128 | 37 | 332 |
| 20 | 50 | 112 | 171 | 49 | 493 |

Drill String Size 4.5 OD, 3.75 ID
Drill Bit Nozzle Area = 0.350 $in^2$
Effective Area Of Pulser = $^{1\ in2}$
By pass Area = $^{0}$ The results show that a sizeable pressure pulse can be developed with modest turndown ratios over a wide range of circulation rates with a flow geometry similar to that of the test unit.

The fluidic approach to mud pulse telemetry appears to offer several potential advantages over mechanical systems. Large flow channels can be used in the apparatus to minimize the chance of clogging. There are no large pressure differentials across the structural components which could give rise to component failure. The actual inner assembly can be housed in a welded inclosure and thus completely isolated from the operating fluids. Switching rates on the order of 20 to 50 hertz should be feasible using conventional solenoid mechanisms. Thus it can be seen that an improved telemetry system has been disclosed which when used in combination with conventional drilling equipment will make possible more rapid development of our natural resources through more efficient drilling procedures while reducing the danger of personal injury and environmental damage resulting from well blow-outs.

We wish it to be understood that we do not desire to be limited to the exact details of construction shown and described, for obvious modifications can be made by a person skilled in the art.

We claim:

1. Apparatus for producing pulses in a fluid passing through a conduit, comprising a bi-stable fluid amplifier having an inlet means for receiving at least a portion of the fluid passing through the conduit, said bi-stable fluid amplifier further comprising two outlet paths, the fluid entering said inlet assuming and maintaining a stable flow condition through one of said two outlet paths, a vortex valve associated with said fluid amplifier, a first of said outlet paths of the amplifier entering said vortex valve radially and a second of said outlet paths entering said vortex valve tangentially whereby said vortex valve will offer relatively low resistance to fluid flow when fluid enters said vortex valve through said first outlet path and relatively high resistance to fluid flow when fluid enters said vortex valve through said second outlet path, control means associated with said fluid amplifier for abruptly altering said stable flow condition through said one outlet path, for deflecting the fluid entering said inlet toward the other of said outlet paths and for establishing and maintaining a stable flow condition through the other of said outlet paths, whereby the abrupt change in resistance to flow into and through said vortex valve results in abrupt changes in the rate of fluid flow into said inlet of said fluid amplifier, and pulses are generated in the fluid entering said amplifier.

2. Apparatus as in claim 1, wherein said amplifier and vortex valve are located at a first position along said conduit, and means for sensing said pulses is located at a second position along said conduit, and information is transmitted from said first position to said second position by said pulses.

3. Apparatus as in claim 2 wherein said conduit is a drill string and the pulses carry encoded information from one portion thereof to another portion thereof.

4. Apparatus as in claim 1, further comprising means in said conduit for providing signals to said control means for controlling the flow of fluid to direct it to either said first or second outlet path.

5. Apparatus as in claim 4 wherein said conduit is a drill string and said means for providing signals comprises means for sensing conditions in a bore hole and generating signals indicative of said conditions.

6. Apparatus as in claim 1 or 2 further comprising means for sensing ambient conditions in the vicinity of one portion of the conduit and providing informational signals indicative of such conditions, said control means being responsive to said signals to direct the flow of fluid.

7. Apparatus as in claim 1 wherein said device receives substantially all of the flow passing through the conduit.

8. A telemetry system for transmitting through a body of fluid, comprising a bi-stable fluid amplifier having an inlet for receiving a flow of at least a portion of said fluid and two outlet paths, the flow entering said inlet assuming and maintaining a stable flow condition through one of said outlet paths, a vortex valve for establishing a different impedence to fluid flow through each of the outlet paths, one of said outlet paths entering said valve radially and one of said outlet paths entering said valve tangentially and control means for abruptly altering said stable flow condition through said one outlet path, for deflecting the flow toward the other outlet path and for establishing and maintaining a stable flow condition through the other outlet path whereby upon said abrupt change in flow paths, a rapid change in impedence to fluid flow results in a pulse in said body of fluid.

9. A telemetry system as in claim 8, further comprising means for receiving said pulses in said body of fluid at a location remote from said amplifier.

10. A system as in claim 8 or 9 wherein said body of fluid comprises fluid flowing through a conduit.

11. A system as in claim 10 wherein the body of fluid comprises fluid flowing through a drill string, the bi-stable amplifier is positioned within the drill string in a bore hole and pulses are received at a location exterior of the bore hole.

* * * * *